US009158269B2

(12) United States Patent
Kang et al.

(10) Patent No.: US 9,158,269 B2
(45) Date of Patent: Oct. 13, 2015

(54) ELECTROPHOTOGRAPHIC IMAGE FORMING APPARATUS HAVING A STABLE CONNECTION OF A DEVELOPER CARTRIDGE AND TONER CARTRIDGE

(71) Applicant: Samsung Electronics Co., Ltd., Suwon-si (KR)

(72) Inventors: Shin-hyup Kang, Suwon-si (KR); Dae-seob Kweon, Suwon-si (KR); Min-su Han, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/281,120

(22) Filed: May 19, 2014

(65) Prior Publication Data

US 2015/0063866 A1 Mar. 5, 2015

Related U.S. Application Data

(60) Provisional application No. 61/873,045, filed on Sep. 3, 2013.

(30) Foreign Application Priority Data

Oct. 17, 2013 (KR) ..... 10-2013-0124151

(51) Int. Cl.

| | |
|---|---|
| ***G03G 21/18*** | (2006.01) |
| ***G03G 15/08*** | (2006.01) |
| ***G03G 21/16*** | (2006.01) |

(52) U.S. Cl.

CPC ..... *G03G 21/1647* (2013.01); *G03G 15/0877* (2013.01); *G03G 21/1676* (2013.01); *G03G 21/1842* (2013.01); *G03G 2221/1654* (2013.01)

(58) Field of Classification Search

CPC ..... G03G 15/0832; G03G 15/0872; G03G 21/1647; G03G 21/1842; G03G 21/185; G03G 2215/066; G03G 2215/0665; G03G 2215/067

USPC ..... 399/113, 258, 262, 119, 120

See application file for complete search history.

(56) References Cited

U.S. PATENT DOCUMENTS

| | | | | |
|---|---|---|---|---|
| 5,475,478 | A * | 12/1995 | Nishimura et al. | 399/119 |
| 5,933,691 | A * | 8/1999 | Johroku | 399/262 |
| 2002/0025192 | A1* | 2/2002 | Matsuda et al. | 399/258 |
| 2007/0160393 | A1 | 7/2007 | Taguchi et al. | |
| 2007/0269237 | A1* | 11/2007 | Sato | 399/260 |
| 2008/0138133 | A1 | 6/2008 | Hatayama et al. | |
| 2011/0142499 | A1* | 6/2011 | Kuge et al. | 399/262 |

FOREIGN PATENT DOCUMENTS

| | | |
|---|---|---|
| EP | 1403734 | 3/2004 |
| EP | 2003513 | 12/2008 |

OTHER PUBLICATIONS

European Search Report dated Jan. 23, 2015 in European Patent Application No. 14172621.6.

* cited by examiner

*Primary Examiner* — Sophia S Chen

(74) *Attorney, Agent, or Firm* — Staas & Halsey LLP

(57) ABSTRACT

An electrophotographic image forming apparatus may include a body frame; a developer cartridge; a toner cartridge mounted in the body frame to be detachable, and is configured to move to a first location where the toner cartridge starts to connect to the developer cartridge to supply toner and to a second location where the connection is completed; at least one first location regulating member provided in the developer cartridge and regulating a relative location of the toner cartridge with respect to the developer cartridge when the toner cartridge is located in the first location; and at least one second location regulating member provided in the body frame and regulating a relative location of the toner cartridge with respect to the developer cartridge so that the toner cartridge is spaced apart from the at least one first location regulating member when the toner cartridge is located in the second location.

16 Claims, 15 Drawing Sheets

ELECTROPHOTOGRAPHIC IMAGE FORMING APPARATUS HAVING A STABLE CONNECTION OF A DEVELOPER CARTRIDGE AND TONER CARTRIDGE

CROSS-REFERENCE TO RELATED APPLICATIONS

This application claims the priority benefit of U.S. Provisional Application No. 61/873,045, filed on Sep. 3, 2013, in the U.S. Patent and Trademark office, and Korean Patent Application No. 10-2013-0124151, filed on Oct. 17, 2013, in the Korean Intellectual Property Office, the disclosures of which are incorporated herein in their entirety by reference.

BACKGROUND

1. Field

One or more embodiments of the present disclosure relate to an electrophotographic image forming apparatus, and more particularly, to an electrophotographic image forming apparatus capable of guaranteeing a stable connection of a developer (development) cartridge and a toner cartridge in a mounting process and minimizing effect due to vibration when mounted.

2. Description of the Related Art

Image forming apparatuses are apparatuses forming an image on a recording medium according to signals that are input, and the image forming apparatuses include printers, photocopiers, fax machines, and multi-function peripherals realized by integrating functions of the printers, the photocopiers, and the fax machines.

Image forming apparatuses are configured by including a body loading or supplying paper and supporting or driving various components in the image forming apparatuses, and a developing unit mounted in the body and forming an image on the paper.

The developing unit may be classified as a one-piece way or a two-piece way according to a print speed, a developing method, and a system layout. The one-piece way is a way in which a portion forming an image and a portion supplying toner are not separated but prepared in one developing unit. The two-piece way is a way in which the portion forming the image and the portion supplying the toner are separated as a developer cartridge and a toner cartridge respectively and mounted in a body of the image forming apparatuses additionally.

In general, in the case of the developing unit of the two-piece way, the developing unit has a structure in which toner contained in the toner cartridge is supplied to the developer cartridge. Here, when a relative location relationship between the developer cartridge and the toner cartridge is not regulated within a consistent margin of error, the toner may not smoothly be supplied or may leak outside the developer cartridge or the toner cartridge, when the toner is transported from the toner cartridge to the developer cartridge.

SUMMARY

In an aspect of one or more embodiments, there is provided an electrophotographic image forming apparatus which has an improved structure in which a location of a toner cartridge is regulated within a consistent margin of error while the toner cartridge is mounted in a body to be connected to a developer cartridge, and, the toner cartridge and the developer cartridge may be spaced apart from each other after the toner cartridge is completely mounted in the body.

In an aspect of one or more embodiments, there is provided an electrophotographic image forming apparatus which includes: a body frame; a developer cartridge mounted in the body frame to be detachable and including a photosensitive drum forming an electrostatic latent image; a toner cartridge mounted in the body frame to be detachable, and capable of moving to a first location where the toner cartridge starts to connect to the developer cartridge to supply toner and to a second location where the connection of the toner cartridge and the developer cartridge to supply the toner is completed; at least one first location regulating member provided in the developer cartridge, and regulating a relative location of the toner cartridge with respect to the developer cartridge when the toner cartridge is located in the first location; and at least one second location regulating member provided in the body frame, and regulating a relative location of the toner cartridge with respect to the developer cartridge so that the toner cartridge is spaced apart from the at least one first location regulating member when the toner cartridge is located in the second location.

The developer cartridge may include a toner inlet, and the toner cartridge may include a toner outlet corresponding to the toner inlet to supply the toner to the developer cartridge and a shutter for opening and closing the toner outlet.

A sealing member sealing between the toner inlet and the toner outlet may be formed in at least one of the toner inlet and the toner outlet.

The first location may be a location where the toner outlet starts to overlap the toner inlet.

The second location may be a location where overlapping of the toner outlet and the toner inlet is completed.

The second location may be a location where the toner cartridge is completely mounted in the body frame.

The at least one first location regulating member may contact the toner cartridge, when the toner inlet and the toner outlet start to overlap each other, or before the toner inlet and the toner outlet start to overlap each other.

The at least one first location regulating member may be released from the contact with the toner cartridge, when overlapping of the toner inlet and the toner outlet is completed.

The toner cartridge may include a contact region that sequentially contacts the at least one first location regulating member and the at least one second location regulating member along a mounting direction, while the toner cartridge is mounted in the body frame.

The contact region may be formed in a leading end in the mounting direction of the toner cartridge.

The at least one second location regulating member may be arranged such that the toner outlet is drawn near to the toner inlet more than the at least one first location regulating member may be arranged such that the toner outlet is drawn near to the toner inlet.

The body frame may include a side portion frame supporting at least an end of the developer cartridge and the toner cartridge, and a bottom frame supporting a bottom of the toner cartridge and comprising a first guide guiding a slide movement of the toner cartridge.

The developer cartridge may include a second guide guiding a slide movement of the toner cartridge.

The toner cartridge may be released from a contact with the second guide, when the toner cartridge is in the second location.

The toner cartridge may be mounted in the body frame in a parallel direction to a lengthwise direction of the photosensitive drum.

In an aspect of one or more embodiments, there is provided an electrophotographic image forming apparatus which includes an electrophotographic image forming apparatus including a body frame; a developer cartridge mounted in the body frame to be detachable; a toner cartridge mounted in the body frame to be detachable, and configured to move to a first location where the toner cartridge starts to connect to the developer cartridge to supply toner and to a second location where the connection of the toner cartridge and the developer cartridge to supply the toner is completed; at least one first location regulating member provided in the developer cartridge, and regulating a relative location of the toner cartridge with respect to the developer cartridge when the toner cartridge is located in the first location; and at least one second location regulating member provided in the body frame, and regulating a relative location of the toner cartridge with respect to the developer cartridge so that the toner cartridge is spaced apart from the at least one first location regulating member when the toner cartridge is located in the second location.

In an aspect of one or more embodiments, there is provided an electrophotographic image forming apparatus which includes a body frame; a developer cartridge mounted in the body frame to be detachable and including a photosensitive drum upon which the electrostatic latent image is formed; an exposure unit to form the electrostatic latent image on the photosensitive drum; a toner cartridge mounted in the body frame to be detachable, and configured to move to a first location where the toner cartridge starts to connect to the developer cartridge to supply toner and to a second location where the connection of the toner cartridge and the developer cartridge to supply the toner is completed; at least one first location regulating member provided in the developer cartridge, and regulating a relative location of the toner cartridge with respect to the developer cartridge when the toner cartridge is located in the first location; and at least one second location regulating member provided in the body frame, and regulating a relative location of the toner cartridge with respect to the developer cartridge so that the toner cartridge is spaced apart from the at least one first location regulating member when the toner cartridge is located in the second location; a transfer roller to transfer a toner image formed on the photosensitive drum from the photosensitive drum to a recording medium; and a fusing unit to fuse the toner image transferred to the recording medium on the recording medium.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
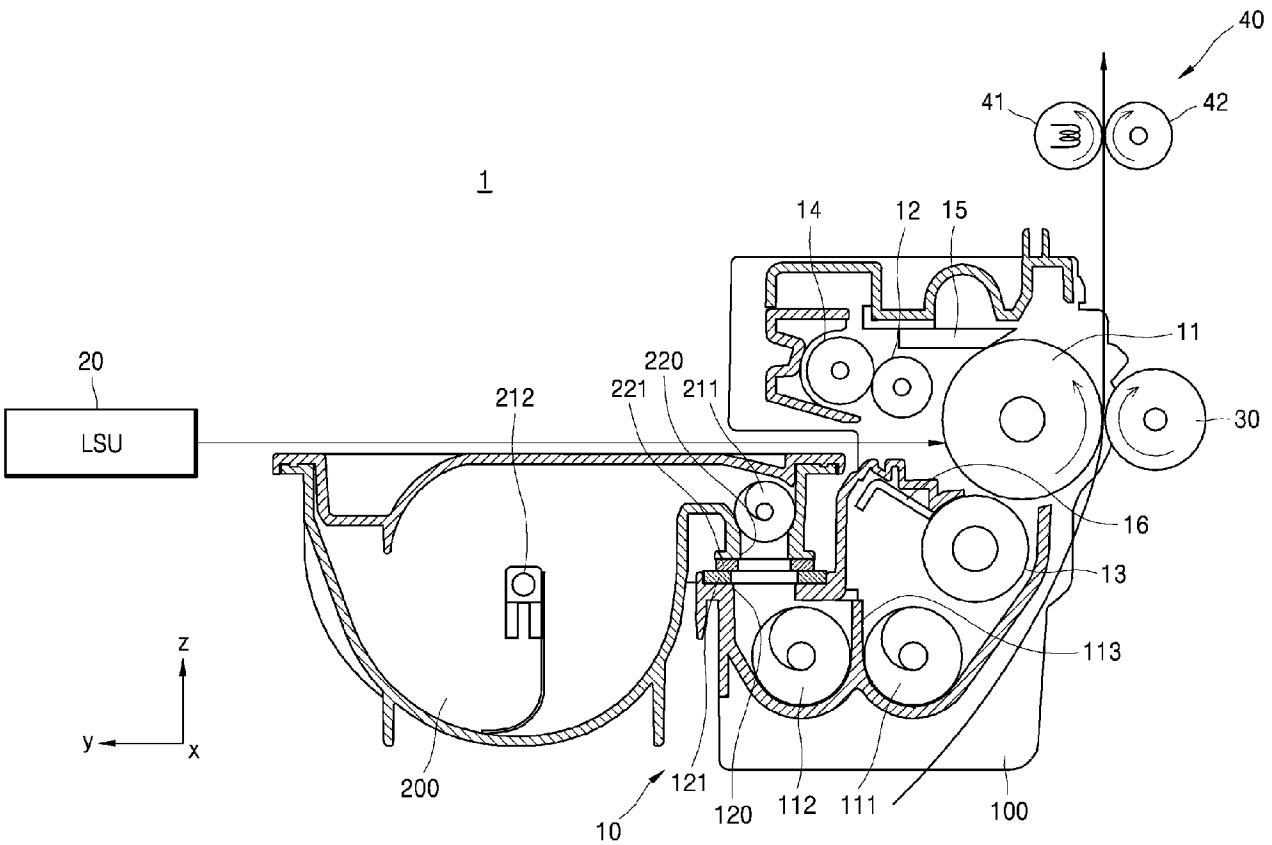
FIG. 1 is a schematic block diagram of an electrophotographic image forming apparatus according to an embodiment.

Reference will now be made in detail to embodiments, examples of which are illustrated in the accompanying drawings, wherein like reference numerals refer to the like elements throughout. In this regard, embodiments may have different forms and should not be construed as being limited to the descriptions set forth herein. Accordingly, embodiments are merely described below, by referring to the figures, to explain aspects of the present description. Expressions such as "at least one of," when preceding a list of elements, modify the entire list of elements and do not modify the individual elements of the list.

FIG. 1 is a schematic diagram of an electrophotographic image forming apparatus 1 according to an embodiment. The electrophotographic image forming apparatus 1 according to an embodiment is a monochrome image forming apparatus using a two-component developing agent including a toner and a magnetic carrier as a developing agent. The toner may be, for example, black color.

Referring to FIG. 1, the electrophotographic image forming apparatus 1 according to an embodiment includes a developing unit 10, an exposure unit 20, a transfer roller 30, and a fusing unit 40. The developing unit 10 includes a photosensitive drum 11, a charging roller 12, and a developer roller 13.

The photosensitive drum 11 is an example of an image carrier, on which an electrostatic latent image is formed, and includes a photosensitive layer having a photoconductivity formed on an outer circumference of a cylindrical metal pipe.

The charging roller 12 is an example of a charger for charging the photosensitive drum 11 to have uniform surface potential. A charging brush or a corona charger may be used instead of the charging roller 12. A cleaning roller 14 may remove foreign materials on a surface of the charging roller 12.

The exposure unit 20 forms an electrostatic latent image on the photosensitive drum 11 by irradiating light modulated according to image information to the photosensitive drum 11. The exposure unit 20 may be a laser scanning unit (LSU) using a laser diode as a light source, or a light-emitting diode (LED) exposure unit using an LED as a light source.

The developer roller 13 supplies toner in a developing agent to the electrostatic latent image formed on the photosensitive drum 11 to form a visible toner image on the surface of the photosensitive drum 11. Reference numeral 16 indicates a regulating member for regulating an amount of toner adhered to a surface of the developer roller 13.

The transfer roller 30 is an example of a transfer unit for transferring a toner image from the photosensitive drum 11 to a recording medium. A transfer bias voltage for transferring the toner image to the recording medium is applied to the transfer roller 30. A corona transfer unit or a transfer unit using a pin scorotron method may be used instead of the transfer roller 30. The toner remaining on the surface of the photosensitive drum 11 after the transfer is removed by a cleaning blade 15. The cleaning blade 15 is an example of a cleaning unit for removing toner and foreign materials on the surface of the photosensitive drum 11 after a transfer process. A cleaning apparatus having another shape, such as a rotating brush, may be used instead of the cleaning blade 15.

The fusing unit 40 fuses a toner image transferred onto the recording medium on the recording medium. The fusing unit 40 includes a heating roller 41 and a pressing roller 42. The heating roller 41 is a member of a cylindrical shape that is rotatable in an axial direction of rotation, and includes a heat source, such as a halogen lamp, inside. The pressing roller 42 is a member of a cylindrical shape that is rotatable in an axial direction of rotation, and is provided to pressurize the heating roller 41. A heat-resistant layer including silicon rubber may be provided on outer circumferential surfaces of the heating roller 41 and the pressing roller 42. The toner image is fused on the recording medium by carrying the recording medium through a fusing nip that is a contacting region of the heating roller 41 and the pressing roller 42.

An operation of the electrophotographic image forming apparatus 1 configured as such will be described.

When the electrophotographic image forming apparatus 1 operates, an image signal of a recording image is transmitted to a control unit (not shown). Then, the control unit charges the surface of the photosensitive drum 11 to a uniform potential based on the received image signal by the charging roller 12, and then, forms an electrostatic latent image by irradiating laser light to the surface of the photosensitive drum 11 by the exposure unit 20.

The developing unit 10 adheres a developing agent, which includes a toner and a carrier, to the developer roller 13, after sufficiently charging the developing agent by mixedly agitating toner and a carrier. Then, the toner in the developing agent adhered to the developer roller 13 moves to the photostatic latent image formed on an outer circumferential surface of the photosensitive drum 11 to form a toner image. The toner image formed like this is transferred onto the recording medium from the photosensitive drum 11 in a transfer nip formed by the photosensitive drum 11 and the transfer roller 30 facing each other.

The recording medium onto which the toner image is transferred is conveyed to the fusing unit 40. The toner image is fused on the recording medium by passing the recording medium between the heating roller 41 and the pressing roller 42 while applying heat and pressure to the recording medium.

Next, a structure and operation of the developing unit 10 according to an embodiment will be described.

Figure 2:
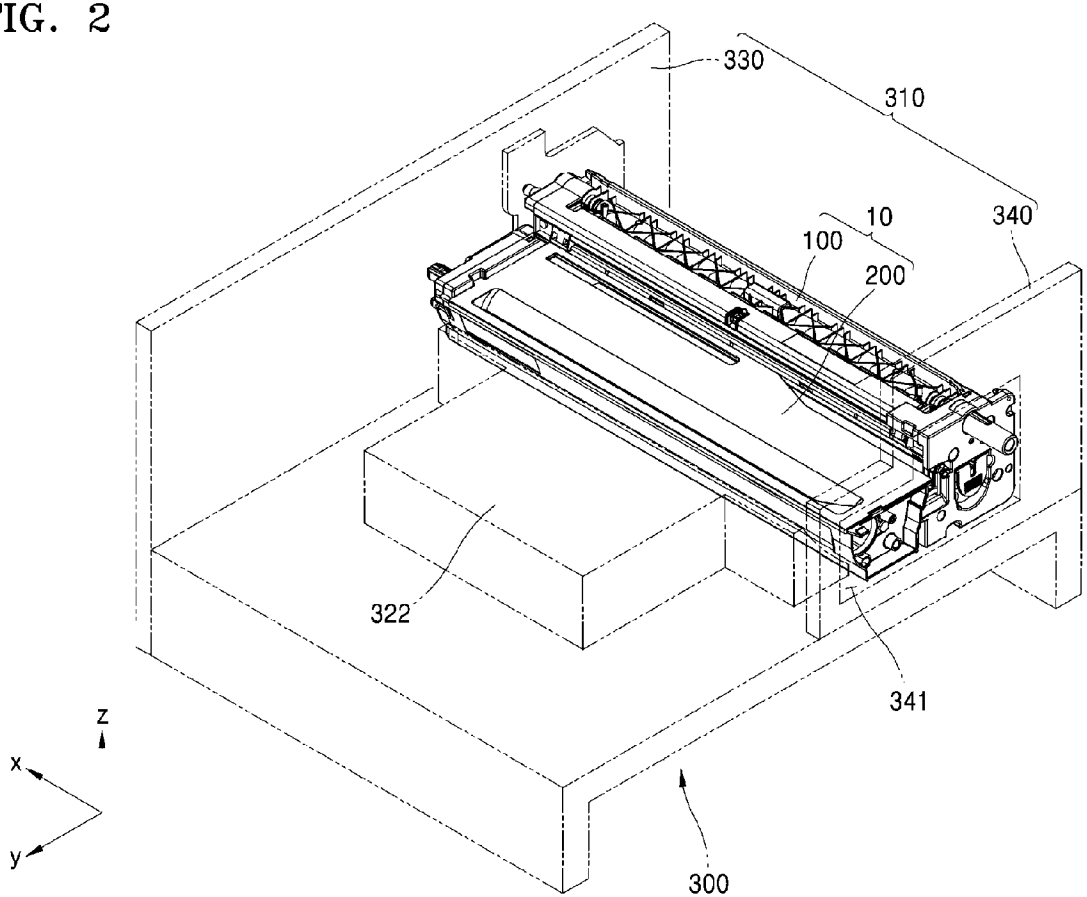
FIG. 2 is a view illustrating a state in which a toner cartridge and a developer cartridge illustrated in FIG. 1 are mounted in a body frame.
Figure 3:
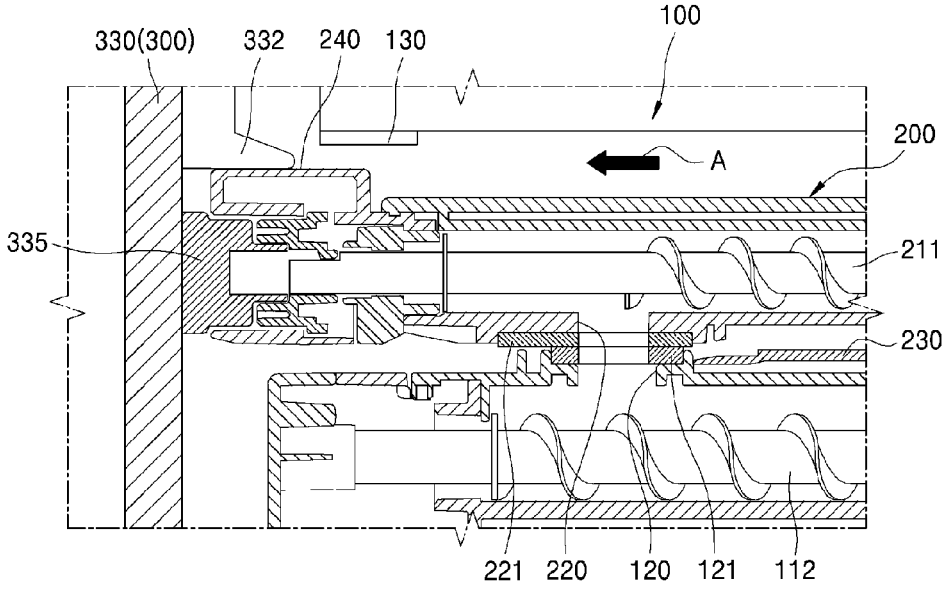
FIG. 3 is a cross-sectional view of a portion of the toner cartridge and the developer cartridge of FIG. 2, taken in a lengthwise direction of a photosensitive drum.

FIG. 2 is a view illustrating a state in which a toner cartridge 200 and a developer cartridge 100 illustrated in FIG. 1 are completely mounted in a body frame 300. FIG. 3 is a cross-sectional view of a portion of the toner cartridge 200 and the developer cartridge 100 of FIG. 2, taken in a lengthwise direction of the photosensitive drum 11.

Referring to FIGS. 1 through 3, the developing unit 10 includes the developer cartridge 100 and the toner cartridge 200. The developer cartridge 100 and the toner cartridge 200 are mounted such that an end in a lengthwise direction (a direction of an x-axis) is supported by the body frame 300.

The developer cartridge 100 includes an agitating unit and a toner inlet 120, in addition to the photosensitive drum 11, the charging roller 12, and the developer roller 13 described above.

The agitating unit of the developer cartridge 100 includes a region where the carrier and the toner are charged by agitating a magnetic carrier and a nonmagnetic or a soft magnetic toner included in the developing agent. The agitating unit of the developer cartridge 100 includes a first agitating member 111 and a second agitating member 112.

The first agitating member 111 is arranged to face the developer roller 13 in an approximately vertical direction, and supplies the mixedly agitated developing agent to the developer roller 13. The second agitating member 112 serves to sufficiently charge the developing agent by mixedly agitating the developing agent, and conveys the charged developing agent to the first agitating member 111. The first and second agitating members 111 and 112 may be for example an auger having a rotation shaft extending in the lengthwise direction (the direction of the x-axis) of the developer roller 13 and a spiral wing formed on an outer circumference of the rotation shaft.

The first and second agitating members 111 and 112 are arranged in parallel. A partition wall 113 is provided between the first agitating member 111 and the second agitating member 112. An opening (not shown) is provided in the partition wall 113 so that the developing agent transported by the first agitating member 111 and the second agitating member 112 is connected at and passes through both ends of the first and second agitating members 111 and 112.

The developing agent conveyed by the second agitating member 112 is conveyed to an outer circumferential surface of the developer roller 13 while being agitated and conveyed by the first agitating member 111. A toner concentration sensor (not shown) for detecting a concentration of the toner may be provided in the second agitating member 112, and, when the concentration of the toner in a conveyance path on which the toner is conveyed decreases, the toner is supplied from the toner cartridge 200 to the inside of the developer cartridge 100. The toner inlet 120 may be formed in a region where the second agitating member 112 is provided.

The toner cartridge 200 contains the toner inside and is connected to the toner inlet 120 of the developer cartridge 100 to supply the toner. The toner cartridge 200 includes an agitating unit and a toner outlet 220.

The agitating unit of the toner cartridge 200 includes a first agitating member 211 agitating and conveying the toner to the developer cartridge 100, and the agitating unit of the toner cartridge 200 includes a second agitating member 212 agitating and conveying the toner contained in the toner cartridge 200 to the first agitating member 211. The first agitating member 211 may for example be an auger including a rotation shaft extending in a lengthwise direction of the developer roller 13 and a spiral wing formed on an outer circumference of the rotation shaft. The second agitating member 212 may for example be a form having the rotation shaft and one or more agitating wings of a flexible film type on the rotation shaft. The toner contained in the toner cartridge 200 is conveyed to the first agitating member 211 by a rotation of the second agitating member 212 and the toner conveyed to the first agitating member 211 is conveyed to the toner outlet 220 by a rotation of the first agitating member 211.

The toner outlet 220 may be formed in a region where the first agitating member 211 is provided. The toner outlet 220 is arranged in a location corresponding to the toner inlet 120 of the developer cartridge 100. The toner discharged through the toner outlet 220 is supplied to the inside of the developer cartridge 100 through the toner inlet 120.

At least one sealing member may be arranged between the toner inlet 120 and the toner outlet 220 to seal therebetween. For example, the toner cartridge 200 further includes a first sealing member 221 arranged in the toner outlet 220, and the developer cartridge 100 further includes a second sealing member 121 arranged in the toner inlet 120. The toner outlet 220 includes a region in which the first sealing member 221 is arranged, and the toner inlet 120 includes a region in which the second sealing member 121 is arranged.

The developer cartridge 100 and the toner cartridge 200 are mounted in the body frame 300, and at least an end thereof is supported by the body frame 300. The developer cartridge 100 and the toner cartridge 200 are consumable products that are replaced when the lives thereof are expired. The lives of the developer cartridge 100 and the toner cartridge 200 may be different, and thus, a two-piece type may be used in which the developer cartridge 100 and the toner cartridge 200 are individually replaced from the body frame 300. When the developer cartridge 100 and the toner cartridge 200 are individually replaced from the body frame 300, for example, when only the toner cartridge 200 is replaced, in a process of connecting the toner cartridge 200 to the developer cartridge 100 to supply the toner, the toner may leak. When the connection of the toner cartridge 200 to the developer cartridge 100 is completed, if the toner cartridge 200 and the developer cartridge 100 directly contact each other, the developer cartridge 100 may be vulnerable to vibration. That is because the vibration of the toner cartridge 200 may be delivered to the developer cartridge 100.

According to an embodiment, in a process of mounting the toner cartridge 200 in the body frame 300, at least one first location regulating member 130 regulating a relative location of the toner cartridge 200 is provided in the developer cartridge 100 so that the toner outlet 220 of the toner cartridge 200 may be stably connected to the toner inlet 120 of the developer cartridge 100. Also, at least one second location regulating member 332 regulating a relative location of the toner cartridge 200 is provided in the body frame 300 lest the vibration occurred in the toner cartridge 200 is delivered to the developer cartridge 100.

Hereinafter, a connection relationship of the developer cartridge 100, the toner cartridge 200, and the body frame 300 will be described by referring to FIGS. 4 through 9, and, characteristics of the first location regulating member 130 provided in the developer cartridge 100 and the second location regulating member 332 provided in the body frame 300 will be described in detail in this connection relationship.

Figure 4:
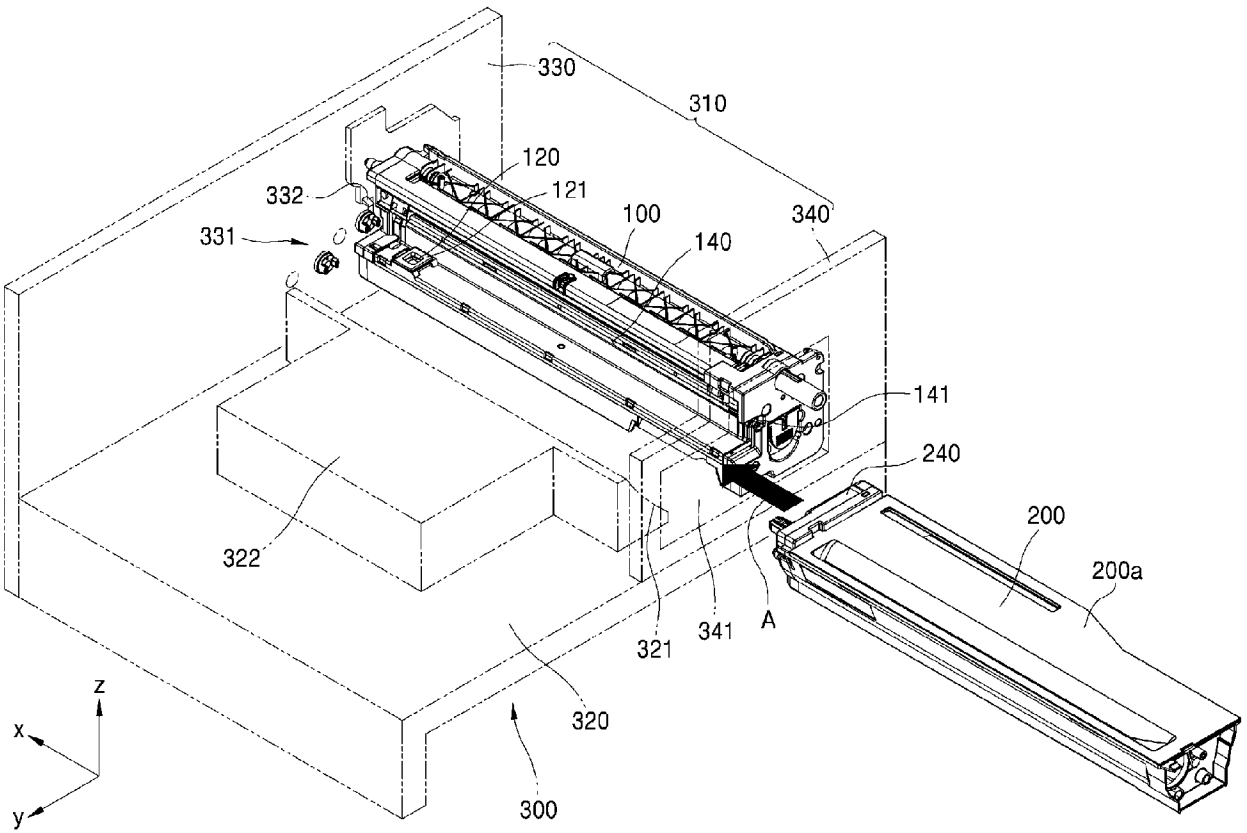
FIG. 4 is a view illustrating a state in which a toner cartridge is not yet mounted in a body frame.
Figure 5:
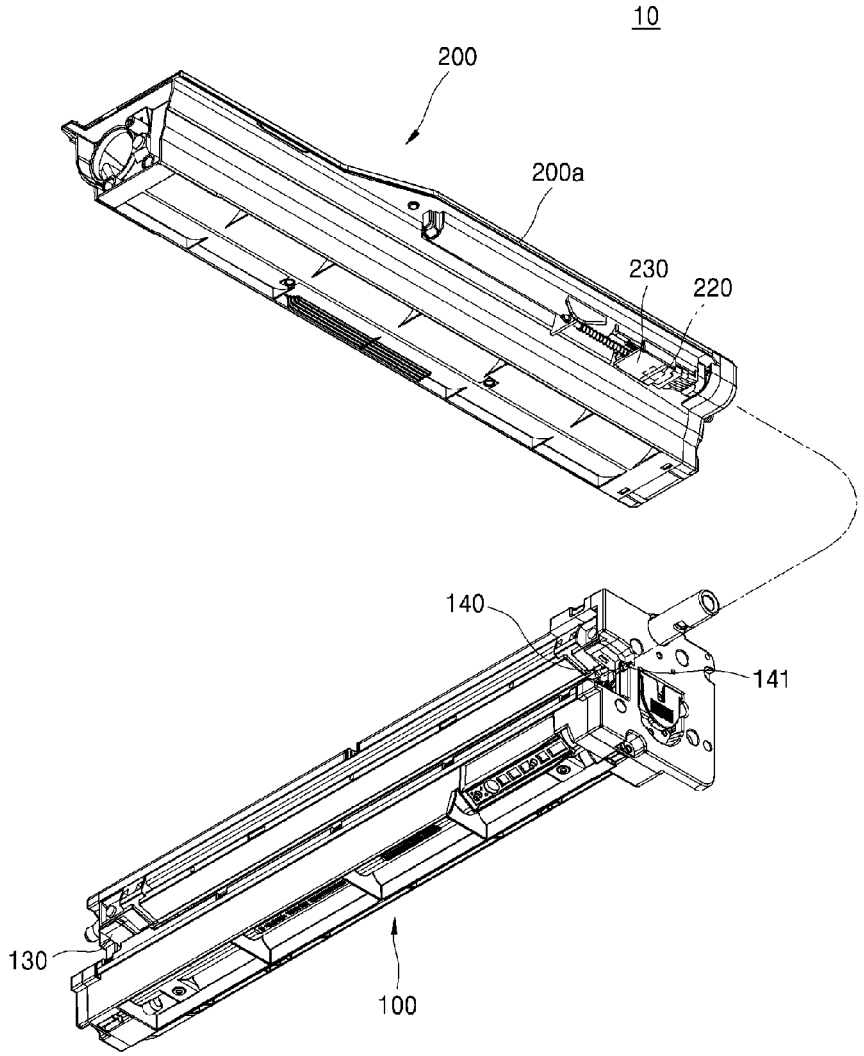
FIG. 5 is a perspective view of the toner cartridge and the developer cartridge of FIG. 4, seen from a different angle.

FIG. 4 is a view illustrating a state in which the toner cartridge 200 is not yet mounted in the body frame 300. FIG. 5 is a perspective view of the toner cartridge 200 and the developer cartridge 100 of FIG. 4, seen from a different angle. Although FIG. 4 does not illustrate a state in which the developer cartridge 100 is mounted/detached in/from the body frame 300, it will be understood that the developer cartridge 100 may be mounted/detached in/from the body frame 300 in the same direction as the toner cartridge 200.

Referring to FIGS. 4 through 5, the developer cartridge 100 and the toner cartridge 200 may be mounted in the body frame 300 to be detachable. For example, the toner cartridge 200 may be mounted along a mounting direction A and detached in a direction opposite to the mounting direction A. The mounting direction A may be a parallel direction to a lengthwise direction (a direction of an x-axis) of the photosensitive drum 11 or the developer roller 13 of the developer cartridge 100.

The body frame 300 may include a side portion frame 310 arranged in both ends in a lengthwise direction of the developer cartridge 100 and the toner cartridge 200, and a bottom frame 320 supporting the weight of the developer cartridge 100 and the toner cartridge 200. Here, the lengthwise direction of the developer cartridge 100 and the toner cartridge 200 is defined as a parallel direction to the mounting direction A of the developer cartridge 100 and the toner cartridge 200.

Figure 6:
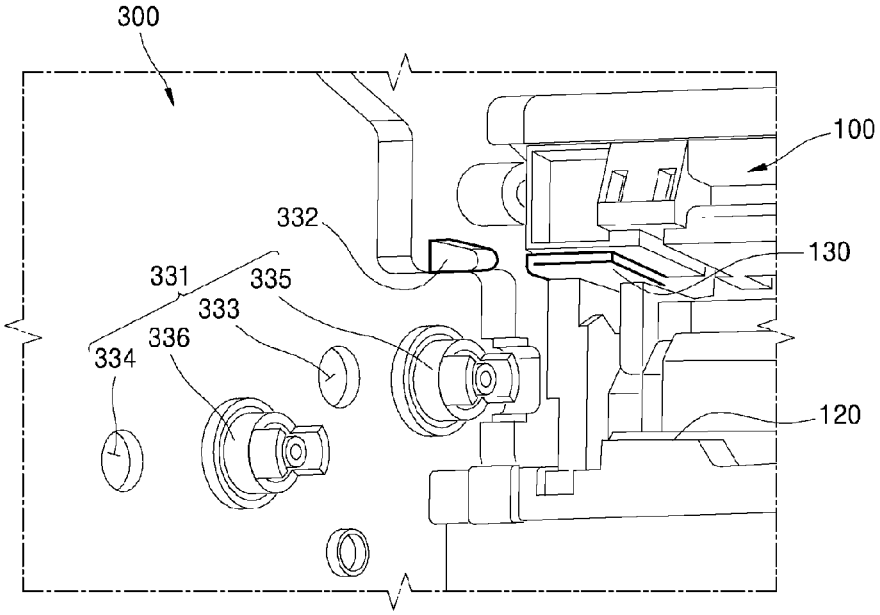
FIG. 6 is a detailed view of a portion of FIG. 4.

The side portion frame 310 includes first and second side portion frames 330 and 340. The side portion frame 310 includes a supporting portion (not shown) supporting an end of the developer cartridge 100 and a supporting portion 331 supporting an end of the toner cartridge 200. FIG. 6 is a detailed view of a portion of FIG. 4. Referring to FIG. 6, the supporting portion 331 includes insertion holes 333 and 334 and couplers 335 and 336. A protrusion unit (not shown) formed in a lead in the mounting direction A of the toner cartridge 200 is inserted into the insertion holes 333 and 334 to support the end of the toner cartridge 200. The couplers 335 and 336 are connected to the first agitating member 211 and the second agitating member 212 of the toner cartridge 200 and deliver a driving force. That is, the supporting portion 331 delivers the driving force to the toner cartridge 200 while supporting the end of the toner cartridge 200.

The first side portion frame 330 includes the second location regulating member 332 regulating a location of the toner cartridge 200. The second location regulating member 332 regulates a relative location of the toner cartridge 200 lest the toner cartridge 200 directly contacts the developer cartridge 100, while guiding the toner cartridge 200 to be connected to the supporting portion 331. In addition, the second location regulating member 332 regulates the location so that the toner outlet 220 of the toner cartridge 200 and the toner inlet 120 of the developer cartridge 100 are stably connected.

The second side portion frame 340 may have an opening 341 through which the developer cartridge 100 and the toner cartridge 200 may pass for the mounting/detachment of the developer cartridge 100 and the toner cartridge 200.

The bottom frame 320 supports the weight of the toner cartridge 200 and the developer cartridge 100. The bottom frame 320 includes a first guide 321 guiding the mounting or detachment of the toner cartridge 200. As the toner cartridge 220 is guided by the first guide 321, the toner outlet 220 of the toner cartridge 200 may naturally draw to the toner inlet 120 of the developer cartridge 100. The bottom frame 320 includes a protrusion region 322 supporting the exposure unit 20 (refer to FIG. 1) irradiating light to the photosensitive drum 11 included in the developer cartridge 100.

The developer cartridge 100 is mounted in the body frame 320 to be detachable. The developer cartridge 100 includes the toner inlet 120 for receiving the toner from the toner cartridge 200. The toner inlet 120 may be formed to be protruding in a cross direction to the mounting direction of the developer cartridge 100, for example a z direction.

The developer cartridge 100 includes the first location regulating member 130 (refer to FIG. 5) regulating the location of the toner cartridge 200 with respect to the developer cartridge 100, when the toner outlet 220 of the toner cartridge 200 starts to overlap the toner inlet 120. The first location regulating member 130 prevents leakage of the toner by regulating a rise of the toner outlet 220 by the first and second sealing members 221 and 121.

Since the first location regulating member 130 is formed in the developer cartridge 100 in which the toner inlet 120 is formed, the distance between the first location regulating member 130 and the toner inlet 120 may be stably maintained. If the first location regulating member 130 is formed in other member than the developer cartridge 100 in which the toner inlet 120 is formed, for example, the body frame 300, a size error and an assembling error of the components formed in the body frame 300 may occur, and thus, the distance between the first location regulating member 130 and the toner inlet 120 that are individually formed in different members may be hard to be maintained stably.

The toner cartridge 200 includes an insertion portion 200*a* that is inserted into the developer cartridge 100. The toner outlet 220 discharging the toner of the toner cartridge 200, and a shutter 230 opening and closing the toner outlet 220 are formed in the insertion portion 200*a*. The developer cartridge 100 may have a groove 140 formed by extending along the mounting direction A so that the insertion portion 200*a* of the toner cartridge 100 may be inserted into the developer cartridge 100 and move along the mounting direction A. For example, the developer cartridge 100 may have a cross-section, the shape of which in a vertical direction of the lengthwise direction (the direction of the x-axis) may be a 'C' shape.

As the toner cartridge 200 moves along the mounting direction A in a state that the insertion portion 200*a* of the toner cartridge 200 is inserted into the groove 140 of the developer cartridge 100, the toner outlet 220 formed in the insertion portion 200*a* is connected to the toner inlet 120 of the developer cartridge 100. The toner outlet 220 is formed such that the toner is discharged in a cross direction to the mounting direction of the toner cartridge 200, for example a vertical direction. The shutter 230 moves to open the toner outlet 220 in a process of mounting the toner cartridge 200 to the body frame 300.

The toner cartridge 200 is connected to the body frame 300 to be detachable. The toner cartridge 200 is capable of moving to a first location 201 (refer to FIG. 9B) where the toner cartridge 200 starts to connect to the developer cartridge 100 to supply the toner, and to a second location 202 (refer to FIG. 9C) where the connection of the toner cartridge 200 and the developer cartridge 100 to supply the toner is completed. The toner cartridge 200 is completely mounted in the body frame 300, by sequentially moving from the first location 201 to the second location 202 along the mounting direction. The first location 201 is a location in which the toner outlet 220 of the toner cartridge 200 starts to overlap the toner inlet 120 of the developer cartridge 100. The second location 202 is a location in which the overlapping of the toner outlet 220 of the toner cartridge 200 and the toner inlet 120 of the developer cartridge 100 is completed.

In a process of mounting the toner cartridge 200 in the body frame 300, when the toner cartridge 200 is located in the first location 201 or the second location 202, a connection state between the toner inlet 120 and the toner outlet 220 may warrant cautions. That is because when the toner cartridge 200 is located in the first location 201, the toner may leak by the first and second sealing members 221 and 121 arranged between the toner inlet 120 and the toner outlet 220. Also, when the toner cartridge 200 is located in the second location 202, if the toner cartridge 200 contacts the developer cartridge 100, the vibration of the toner cartridge 200 may be delivered to the developer cartridge 100.

Figure 7A:
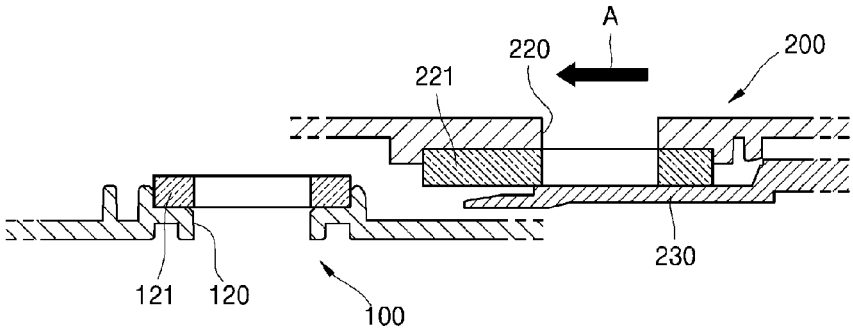
FIGS. 7A and 7B are views schematically illustrating a process in which a toner receiving unit of a toner cartridge overlaps a toner outlet of a developer cartridge.
Figure 7B:
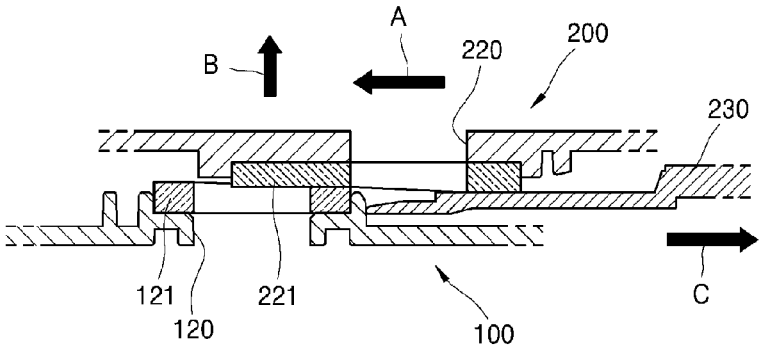

FIGS. 7A and 7B are views schematically illustrating a process in which the toner outlet 220 of the toner cartridge 200 overlaps the toner inlet 120 of the developer cartridge 100. Referring to FIG. 7A, the toner cartridge 200 moves along the mounting direction A. The shutter 230 moves along the mounting direction A with the toner cartridge 200. The shutter 230 moves along the mounting direction A with the toner cartridge 200 until the movement is limited by a contact with the toner inlet 120, and maintains a closing state of the toner outlet 220. Then, as the toner cartridge 200 moves along the mounting direction A, the shutter 230 contacts the toner inlet 120 and the movement is limited. Referring to FIG. 7B, as the toner cartridge 200 moves along the mounting direction A in the state in which the movement of the shutter 230 is limited, the toner outlet 220 is opened. That is, as the shutter 230 of the toner cartridge 200 relatively moves in a direction C opposite to the mounting direction A with respect to the toner outlet 220, the toner outlet 220 is opened. Accordingly, the toner outlet 220 and the toner inlet 120 start to overlap each other.

When the toner outlet 220 and the toner inlet 120 start to overlap each other, the first sealing member 221 arranged in the toner outlet 220 and the second sealing member 121 arranged in the toner inlet 120 contact each other. The first and second sealing members 221 and 121 may be elastic members. Due to the elasticity of the first and second sealing members 221 and 121, an external force is applied to the toner cartridge 200 in a direction (B direction) in which the toner outlet 220 is drawn far from the toner inlet 120. The toner cartridge 200 to which the external force is applied may rise in the B direction temporarily or constantly. As a result, a gap between the toner outlet 220 and the toner inlet 120 may be generated, and the toner in the toner cartridge 200 may leak outside through the gap. The print image formed on the recording medium may be contaminated by the leaking toner, and a secondary fault may occur because the toner may contaminate the inside of the electrophotographic image forming apparatus 1. In FIGS. 7A and 7B, the description is made based on the example in which the first and second sealing members 221 and 121 are arranged between the toner inlet 120 and the toner outlet 220, but the configuration in which the problem occurs is not limited thereto, and the identical problem may occur also when the sealing member is singular or 3 or more.

According to an embodiment, when the toner cartridge 200 is located in the first location 201 where the toner cartridge 200 starts to connect to the developer cartridge 100 to supply the toner, the location of the toner cartridge 200 with respect to the developer cartridge 100 is regulated by the first location regulating member 130 provided in the developer cartridge 100. The first location regulating member 130 may be formed in a section in a lengthwise direction (a direction of an x-axis) of the developer cartridge 100. However, the formation of the first location regulating member 130 is not limited thereto, and, although it is not shown in the drawings, the first location regulating member 130 may be formed throughout the entire section in the lengthwise direction (the direction of the x-axis) of the developer cartridge 100.

Figure 8A:
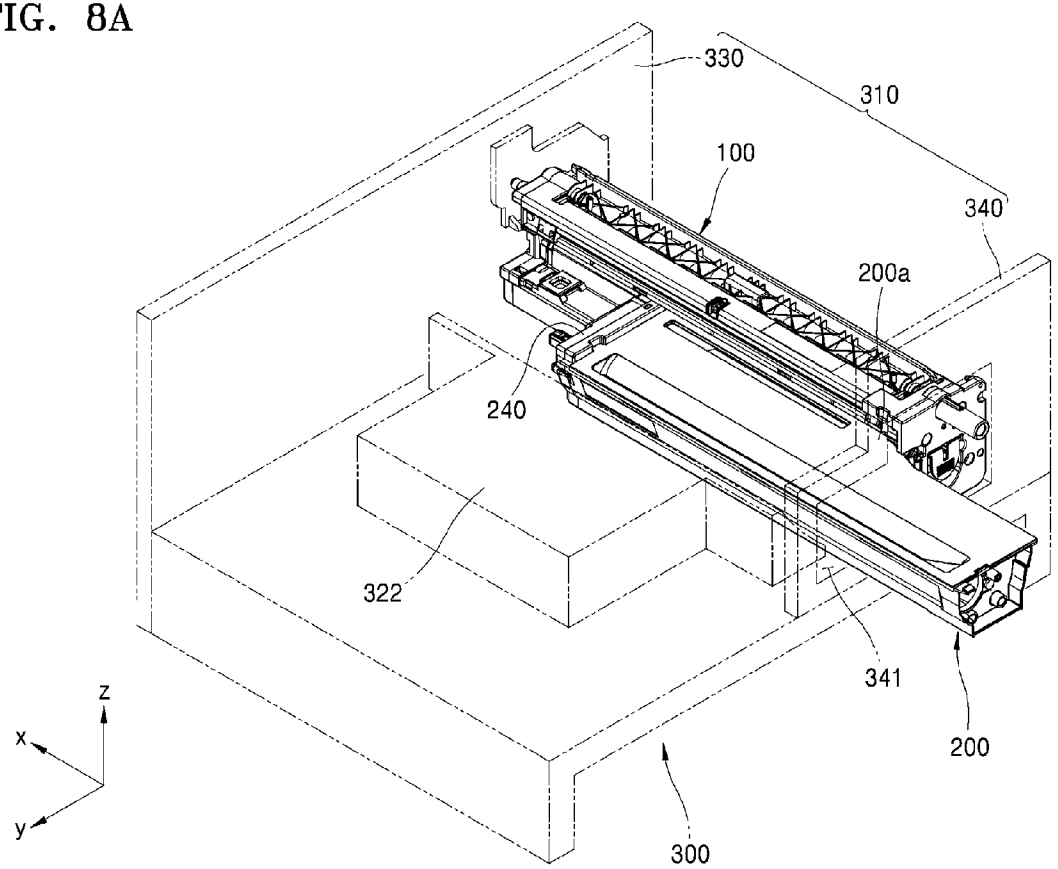
FIGS. 8A through 8C are perspective views illustrating a process in which a toner cartridge is mounted in a body frame according to a mounting direction.
Figure 8B:
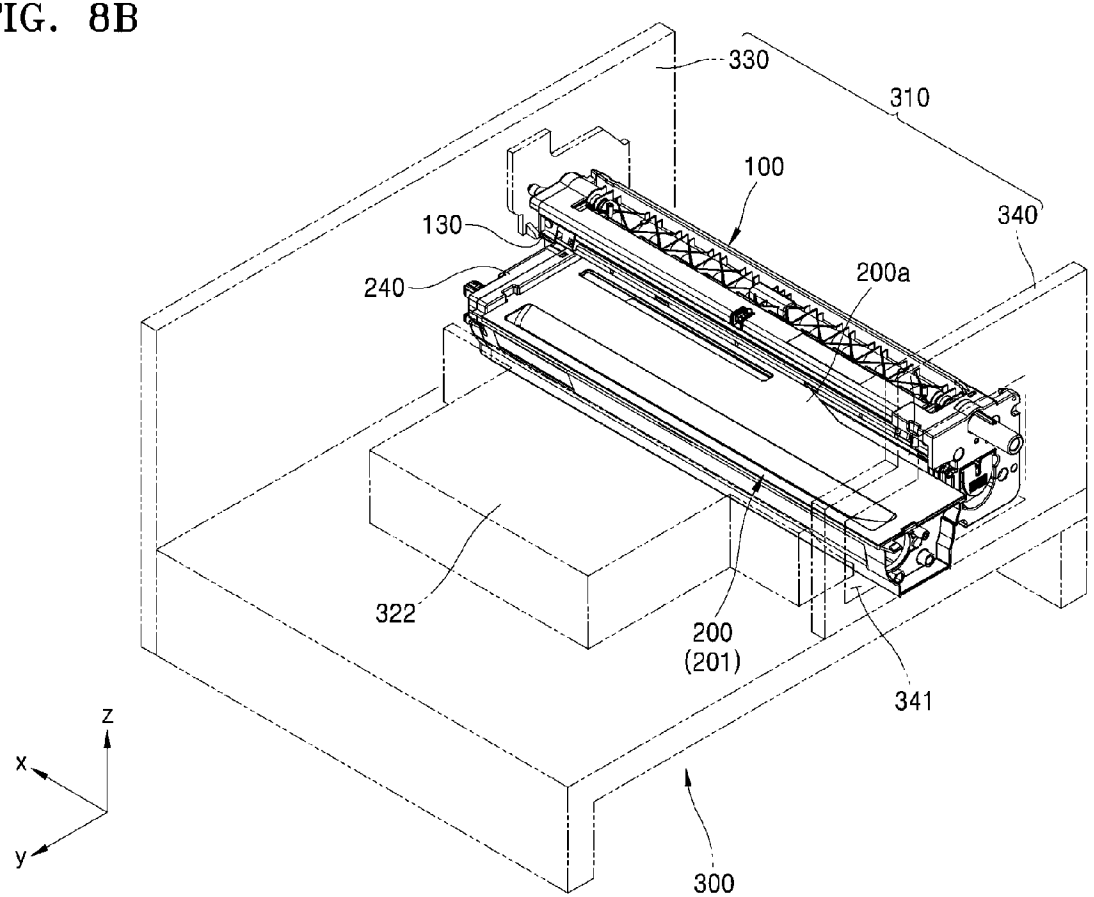
Figure 8C:
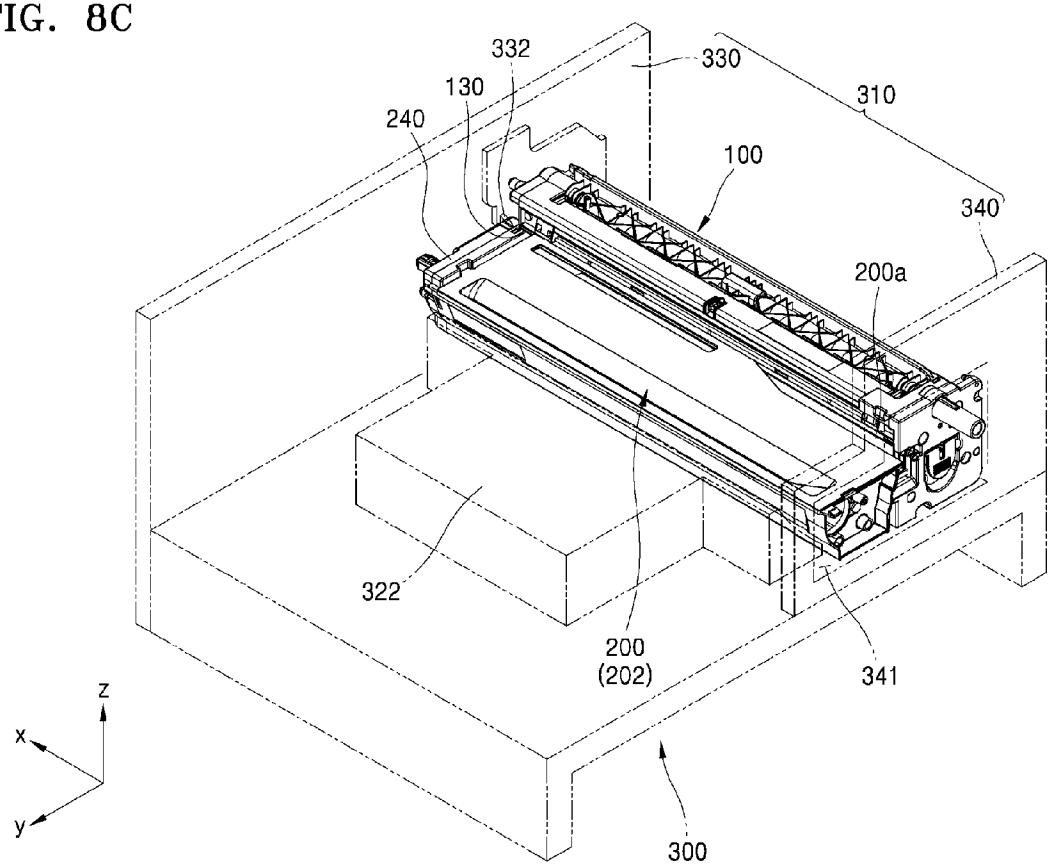
Figure 9A:
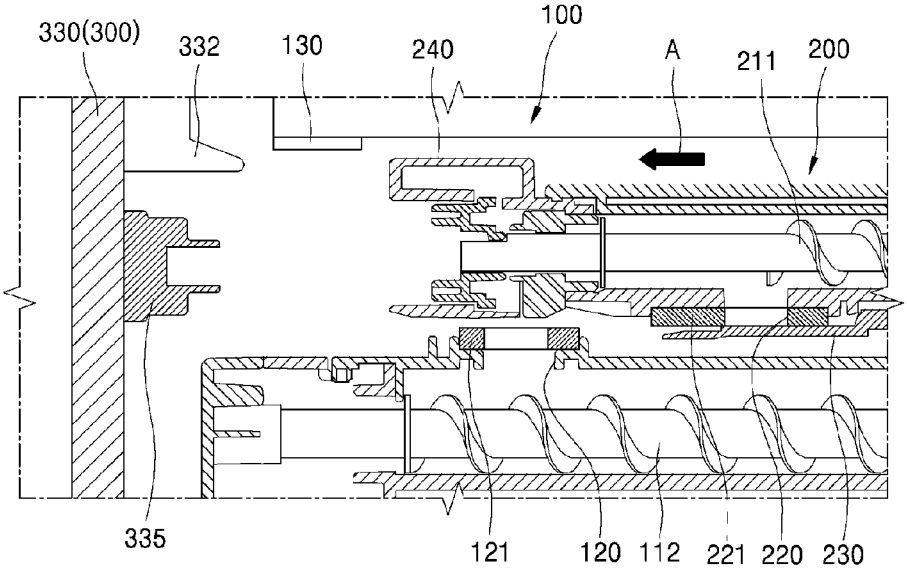
FIGS. 9A through 9C are partial cross-sectional views of a portion of FIGS. 8A through 8C, taken in a lengthwise direction of a photosensitive drum.
Figure 9B:
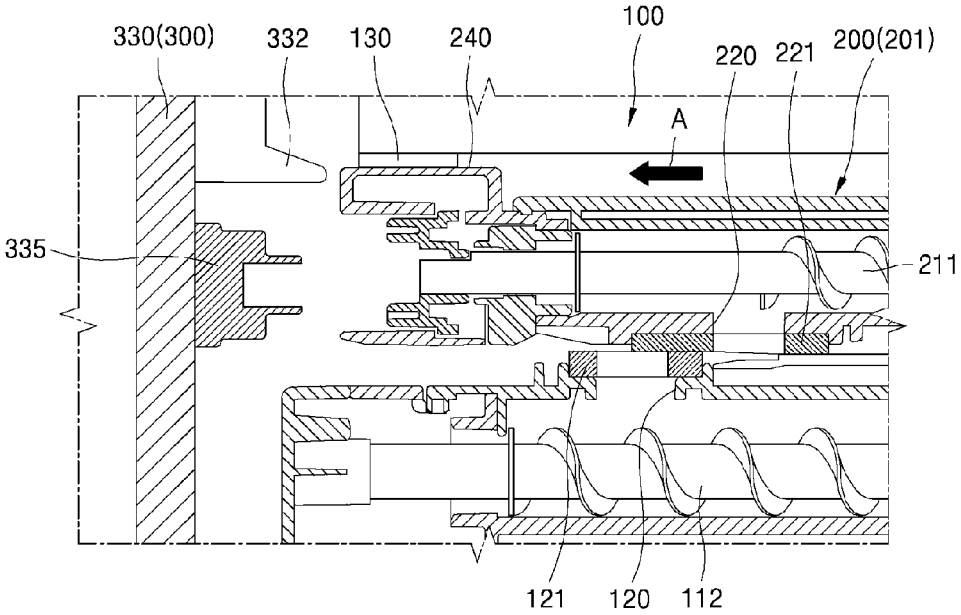
Figure 9C:
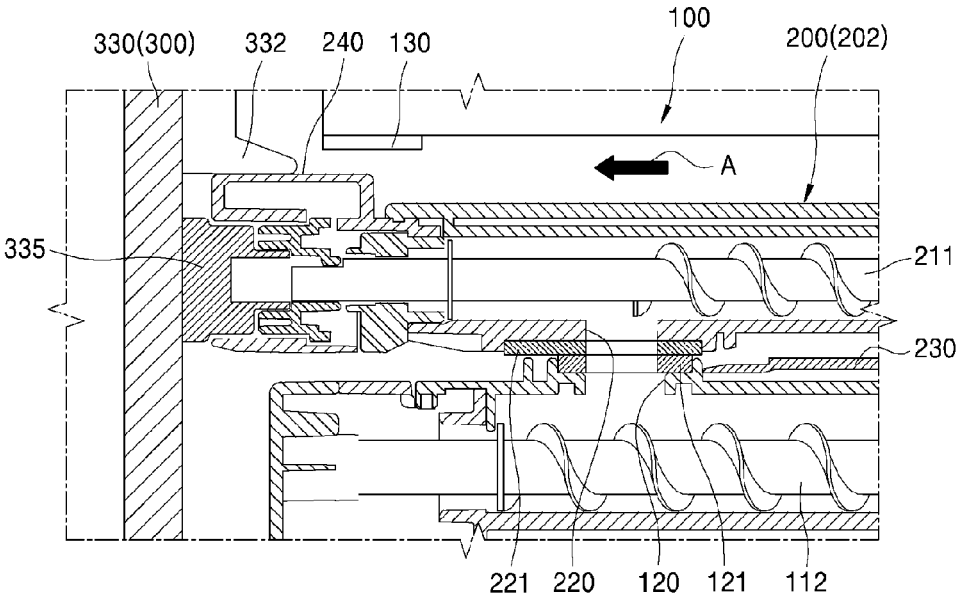

FIGS. 8A through 8C are perspective views illustrating a process in which the toner cartridge 200 is mounted in the body frame 300 according to the mounting direction A. FIGS. 9A through 9C are partial cross-sectional views of a portion of FIGS. 8A through 8C, taken in a lengthwise direction of the photosensitive drum 11.

Referring to FIGS. 8A and 9A, the insertion portion 200*a* of the toner cartridge 200 moves along the mounting direction A while being inserted into the developer cartridge 100. Here, since the toner outlet 220 of the toner cartridge 200 is closed by the shutter 230, the discharging of the toner is limited.

Referring to FIGS. 8B and 9B, as the toner cartridge 200 of FIG. 9A moves along the mounting direction A, the toner cartridge 200 is located in the first location 201, and the toner inlet 120 starts to overlap the toner outlet 220. The first location regulating member 130 contacts the contact region 240 of the toner cartridge 200 when the toner inlet 120 and the toner outlet 220 start to overlap each other, or before the toner inlet 120 and the toner outlet 220 start to overlap each other. The contact region 240 may be formed in a leading end in the mounting direction A of the toner cartridge 200. As the toner inlet 120 starts to overlap the toner outlet 220, the first sealing member 221 arranged in the toner outlet 220 and the second sealing member 121 arranged in the toner inlet 120 contact each other, and thus, by the elasticity of the first and second sealing members 221 and 121, an external force is applied to the toner cartridge 200 in a direction in which the toner outlet 220 is drawn far from the toner inlet 120. Here, since the first location regulating member 130 contacts the contact region 240 of the toner cartridge 200, the location or the height of the toner cartridge 200 located in the first location 201 may be regulated, although the external force is applied to the toner cartridge 200 by the first and second sealing members 221 and 121. By this, a generation of a gap between the toner outlet 220 and the toner inlet 120 may be prevented in the mounting process of the toner cartridge 200, thereby preventing the toner from leaking outside. Here, regulating of the location by the first location regulating member 130 is defined as regulating the location in a cross direction to the mounting direction A of the toner cartridge 200, for example a vertical direction (a direction of a z-axis.)

When the mounting of the toner cartridge 200 is completed, that is, when the toner cartridge 200 is located in the second location 202, the contact of the first location regulating member 130 and the toner cartridge 200 is released. By this, vibration generated in the toner cartridge 200 may be prevented from being delivered to the developer cartridge 100 along the first location regulating member 130.

Figure 10:
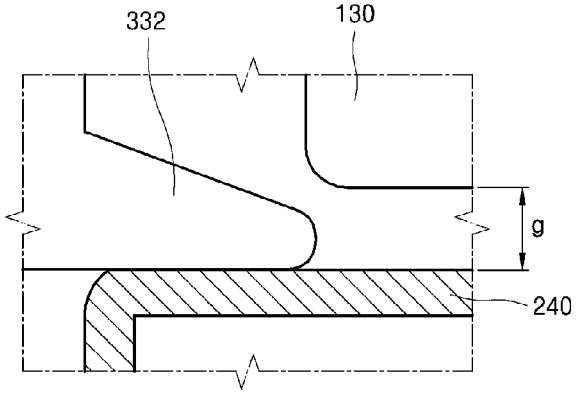
FIG. 10 is a detailed view of a portion of FIG. 9C.

Referring to FIGS. 8C and 9C, as the toner cartridge 200 moves in the mounting direction A, an end of the toner cartridge 200 is combined to and supported by the first side portion frame 330. The coupler 335 is connected to the first agitating member 211 to deliver a driving force. The toner outlet 220 of the toner cartridge 200 is connected to the toner inlet 120 of the developer cartridge 100. FIG. 10 is a detailed view of a portion of FIG. 9C. Referring to FIGS. 9C and 10, the second location regulating member 332 regulates a location of the toner cartridge 200 with respect to the developer cartridge 100, when the toner cartridge 200 is located in the second location 202. Here, the regulating of the location by the second location regulating member 130 and 332 is defined as regulating the location in a cross direction to the mounting direction A, for example, a vertical direction.

The second location regulating member 332 regulates the location in a direction in which the toner outlet 220 of the toner cartridge 200 is drawn near to the toner inlet 120 of the developer cartridge 100 more than the first location regulating member 130 regulates the location in a direction in which the toner outlet 220 of the toner cartridge 200 is drawn near to the toner inlet 120 of the developer cartridge 100. Accordingly, the contact region 240 of the toner cartridge 200 and the first location regulating member 130 may be spaced apart from each other by a certain gap g. Here, the first and second sealing members 221 and 121 arranged between the toner inlet 120 and the toner outlet 220 may be compressed more than when the contact region 240 contacts the first location regulating member 130. The second location regulating member 332 may be arranged closer to a vertical direction to the mounting direction A by a certain gap g than the first location regulating member 130 may be done.

As the toner cartridge 200 and the first location regulating member 130 are spaced apart, the toner cartridge 200 may be spaced apart from the developer cartridge 100. Since the toner cartridge 200 is spaced apart from the developer cartridge 100, even if the agitating unit of the toner cartridge 200 operates and generates vibration, the vibration may be prevented from being delivered to the developer cartridge 100 or may be minimized. The toner inlet 120 of the developer cartridge 100 and the toner outlet 220 of the toner cartridge 200 are indirectly connected by the sealing members 121 and 221. Due to elasticity of the sealing members 121 and 221, the vibration may be absorbed by the sealing members 121 and 221.

Figure 11:
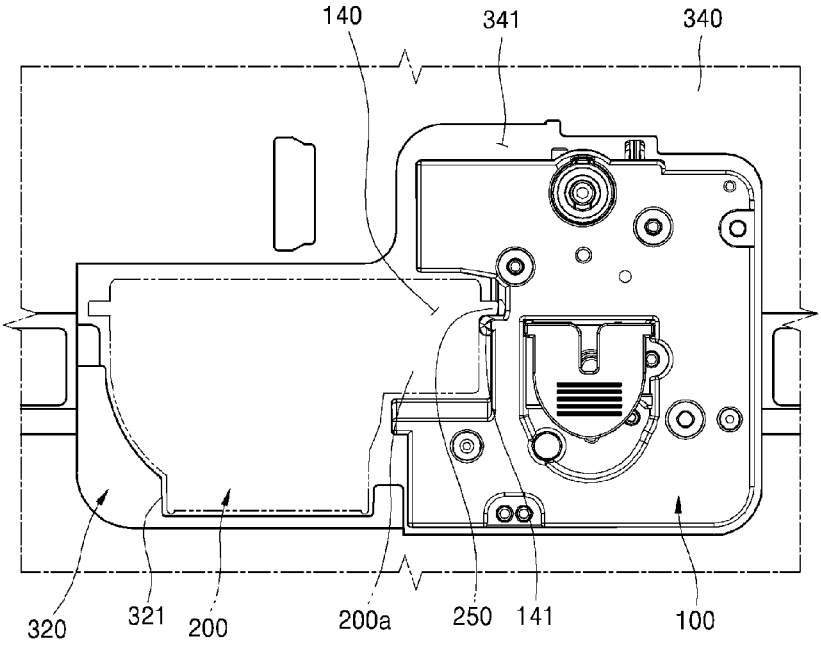
FIG. 11 is a side view of the toner cartridge and the developer cartridge of FIG. 3, seen from a right direction.
Figure 12:
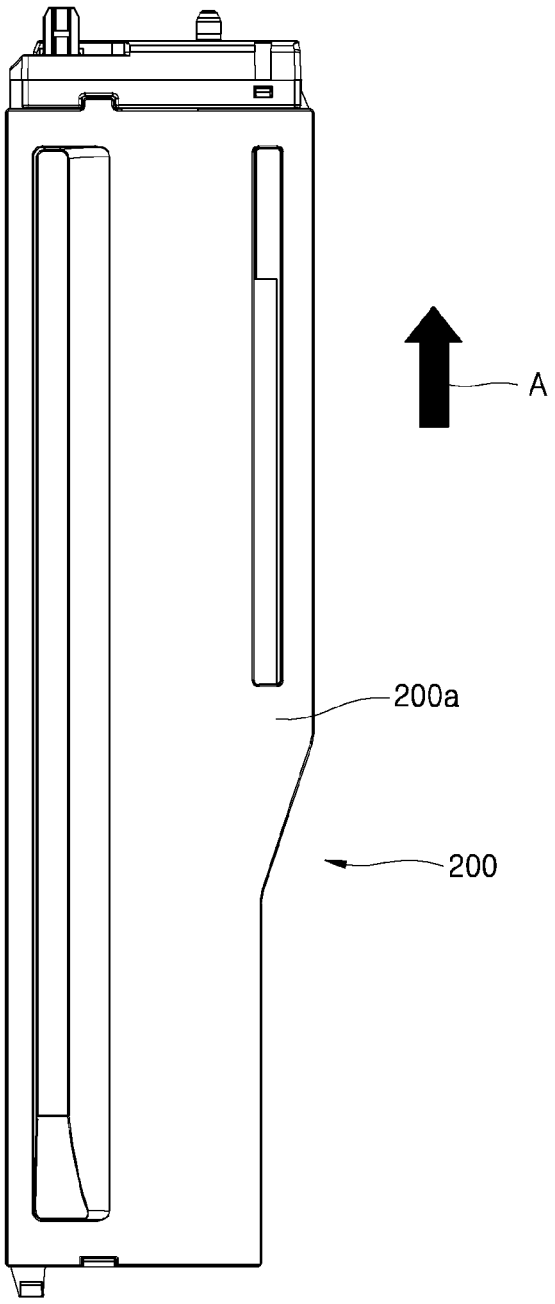
FIG. 12 is a plan view of the toner cartridge of FIG. 3.

FIG. 11 is a side view of the toner cartridge 200 and the developer cartridge 100 of FIG. 3, seen from a right direction. FIG. 12 is a plan view of the toner cartridge 200 of FIG. 3. In FIG. 11, the toner cartridge 200 is illustrated in dotted lines for convenience of explanation.

The toner cartridge 200 may slide along the mounting direction A by being guided by the bottom frame 320 of the body frame 300 and the developer cartridge 100 in an early mounting process. A portion of the toner cartridge 200 may be inserted into the first guide 321 of the bottom frame 320 and the other portion of the toner cartridge 200 may be inserted into the second guide 141 of the developer cartridge 100. For example, the toner cartridge 200 is inserted into a space formed by the bottom frame 320 and the developer cartridge 100 so that a bottom portion and a side portion of the toner cartridge 200 contacts the first guide 321 of the bottom frame 320 and a portion 250 of the insertion portion 200*a* of the toner cartridge 200 contacts the second guide 141 of the developer cartridge 100. Here, the insertion portion 200*a* of the toner cartridge 200 contacts the second guide 141, but does not contact the groove 140.

In this state, as the toner cartridge 200 moves along the mounting direction A, the toner cartridge 200 is mounted to have one side portion supported by the first side portion frame 330, and the toner outlet 220 is connected to the toner inlet 120 of the developer cartridge 100. The first guide 321 of the bottom frame 320 supports the weight of the toner cartridge 200, and the second guide 141 of the developer cartridge 100 may drive a stable insertion of the insertion portion 200*a* of the toner cartridge 200 into the groove 140 of the developer cartridge 100. Since the insertion portion 200*a* may be stably inserted into the groove 140 of the developer cartridge 100 by the second guide 141, the leakage of the toner due to an unintentional opening of the shutter 230 as the insertion portion 200*a* of the toner cartridge 200 is mis-inserted into the groove 140 of the developer cartridge 100 may be prevented.

The insertion portion 200*a* of the toner cartridge 200 may be formed in a section along the mounting direction A. As the insertion portion 200*a* is formed in the section, the toner cartridge 200 is guided by the second guide 141 contacting the toner cartridge 200 in an early mounting process, while after the toner cartridge 200 is mounted in the body frame 300, that is, when the toner cartridge 200 is located in the second location 202, the insertion portion 200*a* is released from the contact with the second guide 141. To this end, a section of the insertion portion 200*a* is formed in a lead in the mounting direction A of the toner cartridge 200, and is not formed in a rear of the mounting direction A.

As described above, according to one or more of the above embodiments, the toner leakage outside may be prevented by regulating the locations of the developer cartridge 100 and the toner cartridge 200 within a consistent margin or error in a process of connecting the developer cartridge 100 and the toner cartridge 200. Also, when the developer cartridge 100 and the toner cartridge 200 are completely connected to each other, the vibration generated in the toner cartridge 200 may be prevented from having effects on the developer cartridge 100.

It should be understood that exemplary embodiments described herein should be considered in a descriptive sense only and not for purposes of limitation. Descriptions of features or aspects within each embodiment should typically be considered as available for other similar features or aspects in other embodiments.

While a few of embodiments have been described with reference to the figures, it will be understood by those of ordinary skill in the art that various changes in form and details may be made therein without departing from the spirit and scope of the present disclosure as defined by the following claims and their equivalents.

What is claimed is:

1. An electrophotographic image forming apparatus comprising:

a body frame;

a developer cartridge mounted in the body frame to be detachable and including a photosensitive drum upon which an electrostatic latent image is formed;

a toner cartridge mounted in the body frame to be detachable, and configured to move to a first location where the toner cartridge starts to connect to the developer cartridge to supply toner and to a second location where the connection of the toner cartridge and the developer cartridge to supply the toner is completed;

at least one first location regulating member provided in the developer cartridge, and regulating a relative location of the toner cartridge with respect to the developer cartridge when the toner cartridge is located in the first location; and at least one second location regulating member provided in the body frame, and regulating a relative location of the toner cartridge with respect to the developer cartridge so that the toner cartridge is spaced apart from the at least one first location regulating member when the toner cartridge is located in the second location.

2. The electrophotographic image forming apparatus of claim 1, wherein the developer cartridge comprises a toner inlet, and the toner cartridge comprises a toner outlet corresponding to the toner inlet to supply the toner to the developer cartridge and a shutter for opening and closing the toner outlet.

3. The electrophotographic image forming apparatus of claim 2, wherein a sealing member, which seals between the toner inlet and the toner outlet, is formed in at least one of the toner inlet and the toner outlet.

4. The electrophotographic image forming apparatus of claim 3, wherein the first location is a location where the toner outlet starts to overlap the toner inlet.

5. The electrophotographic image forming apparatus of claim 3, wherein the second location is a location where overlapping of the toner outlet and the toner inlet is completed.

6. The electrophotographic image forming apparatus of claim 2, wherein the at least one first location regulating member contacts the toner cartridge, when the toner inlet and the toner outlet start to overlap each other, or before the toner inlet and the toner outlet start to overlap each other.

7. The electrophotographic image forming apparatus of claim 2, wherein the at least one first location regulating member is released from the contact with the toner cartridge, when overlapping of the toner inlet and the toner outlet is completed.

8. The electrophotographic image forming apparatus of claim 2, wherein the toner cartridge comprises a contact region that sequentially contacts the at least one first location regulating member and the at least one second location regulating member along a mounting direction, while the toner cartridge is mounted in the body frame.

9. The electrophotographic image forming apparatus of claim 8, wherein the contact region is formed in a leading end in the mounting direction of the toner cartridge.

10. The electrophographic image forming apparatus of claim 2, wherein the at least one second location regulating member is arranged such that the toner outlet is drawn near to the toner inlet more than the at least one first location regulating member is arranged such that the toner outlet is drawn near to the toner inlet.

11. The electrophotographic image forming apparatus of claim 1, wherein the second location is a location where the toner cartridge is completely mounted in the body frame.

12. The electrophotographic image forming apparatus of claim 1, wherein the body frame comprises a side portion frame supporting at least an end of the developer cartridge and the toner cartridge, and a bottom frame supporting a bottom of the toner cartridge and comprising a first guide guiding a slide movement of the toner cartridge.

13. The electrophotographic image forming apparatus of claim 12, wherein the developer cartridge comprises a second guide guiding a slide movement of the toner cartridge.

14. The electrophotographic image forming apparatus of claim 13, wherein the toner cartridge is released from a contact with the second guide, when the toner cartridge is in the second location.

15. The electrophotographic image forming apparatus of claim 1, wherein the toner cartridge is mounted in the body frame in a parallel direction to a lengthwise direction of the photosensitive drum.

16. An electrophotographic image forming apparatus comprising:

a body frame;

a developer cartridge mounted in the body frame to be detachable;

a toner cartridge mounted in the body frame to be detachable, and configured to move to a first location where the toner cartridge starts to connect to the developer cartridge to supply toner and to a second location where the connection of the toner cartridge and the developer cartridge to supply the toner is completed;

at least one first location regulating member provided in the developer cartridge, and regulating a relative location of the toner cartridge with respect to the developer cartridge when the toner cartridge is located in the first location; and at least one second location regulating member provided in the body frame, and regulating a relative location of the toner cartridge with respect to the developer cartridge so that the toner cartridge is spaced apart from the at least one first location regulating member when the toner cartridge is located in the second location.

* * * * *